US008469652B2

(12) United States Patent
Muraoka et al.

(10) Patent No.: US 8,469,652 B2
(45) Date of Patent: Jun. 25, 2013

(54) GRIPPING DEVICE OF WORKING MACHINE AND WORKING MACHINE WITH THE SAME

(75) Inventors: Daisuke Muraoka, Hiroshima (JP); Michiharu Mukai, Hiroshima (JP); Takanori Yamasaki, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 593 days.

(21) Appl. No.: 12/768,005

(22) Filed: Apr. 27, 2010

(65) Prior Publication Data

US 2010/0290884 A1 Nov. 18, 2010

(30) Foreign Application Priority Data

May 15, 2009 (JP) ..... 2009-118814

(51) Int. Cl.
*B66C 1/22* (2006.01)
*B66C 1/36* (2006.01)
*B66C 3/16* (2006.01)

(52) U.S. Cl.
USPC ..... 414/739; 294/110.1; 294/198; 294/207

(58) Field of Classification Search
USPC ..... 414/739; 294/110.1, 110.2, 119.1, 294/198, 207
See application file for complete search history.

(56) References Cited

U.S. PATENT DOCUMENTS 3,529,735 A * 9/1970 Wehde ..... 414/739
3,987,905 A 10/1976 Dechantsreiter
4,727,647 A * 3/1988 Matson et al. ..... 29/838
5,061,150 A * 10/1991 Rentschler ..... 414/703
5,092,734 A * 3/1992 Sakoda et al. ..... 414/798
5,645,236 A 7/1997 Sugiura et al.
2010/0296904 A1 * 11/2010 Muraoka et al. ..... 414/729

FOREIGN PATENT DOCUMENTS

| | | |
|---|---|---|
| DE | 2 247 052 | 4/1974 |
| DE | 24 01 408 | 4/1975 |
| DE | 35 00 056 A1 | 7/1986 |
| EP | 0 005 260 | 11/1979 |
| JP | 57-80554 | 5/1982 |
| JP | 60-175634 | 9/1985 |
| JP | 2-200974 | 8/1990 |
| JP | 2691795 | 12/1997 |
| JP | 2005-206291 | 8/2005 |

OTHER PUBLICATIONS

Office Action issued on Aug. 3, 2011 in the corresponding Chinese Patent Application No. 201010180310.8 (with English Translation).
U.S. Appl. No. 12/783,143, filed May 19, 2010, Muraoka, et al.
Extended European Search Report issued Sep. 20, 2010 in EP 10 16 2094.

* cited by examiner

*Primary Examiner* — Scott Lowe
(74) *Attorney, Agent, or Firm* — Oblon, Spivak, McClelland, Maier & Neustadt, L.L.P.

(57) ABSTRACT

A gripping device includes a spring member provided between a gripping member body and a shaft so that driving of a gripping driving cylinder causes a driving force to be transmitted from the gripping driving cylinder to the body while the shaft and the body are held in a predetermined positional relationship; so that the body is allowed to retreat with respect to the shaft by elastically deforming the spring member by an opposing force received from a processing object that contacts the body as a result of rotating the body; and so that contact pressure of the body with respect to the processing object is increased by an elastic force of the spring member as the body retreats.

6 Claims, 9 Drawing Sheets

GRIPPING DEVICE OF WORKING MACHINE AND WORKING MACHINE WITH THE SAME

BACKGROUND OF THE INVENTION

1. Field of the Invention

The present invention relates to a gripping device provided at an end of a working arm of a working machine such as a hydraulic excavator, and used for gripping a processing object for, for example, tearing down a building or breaking up and separating industrial waste; and to a working machine including the gripping device.

2. Description of the Related Art

Hitherto, a gripping device discussed in Japanese Patent No. 2691795 (hereunder referred to as "Patent Document 1") is known as a gripping device provided at an end of a working arm of a working machine. The gripping device includes a frame bracket, a pair of arm links, an arm cylinder, and link connecting members for gripping. The frame bracket is mounted to the end of the working arm. The pair of arm links are provided at the frame bracket so as to be openable and closable with respect to the frame bracket. The arm cylinder opens and closes the arm links. Each link connecting member is provided at one end of its corresponding arm link. More specifically, each link connecting member for gripping includes a plurality of gripping links and pins that connect the gripping links that are adjacent thereto. By applying tension to or removing tension from a tension member, such as a wire, provided between the gripping link at the outermost end and a rotating frame, the link connecting members can be bent along a periphery of a grip object.

A gripping device discussed in Japanese Unexamined Utility Model Registration Application Publication No. 57-80554 (hereunder referred to as "Patent Document 2") is known as a another gripping device. The gripping device includes a supporting bracket, a pair of gripping arms, and a cylinder device. The supporting bracket is mounted to the end of the working arm. The pair of gripping arms are rotatably mounted to the supporting bracket. The cylinder device rotates the gripping arms. The cylinder device causes the gripping arms to perform gripping operations by rotating both of the gripping arms in opposite directions.

The gripping device may be required to provide a large gripping force. In particular, for the purpose of breaking a strong work object, a very large driving power is required, thereby making it necessary to include a cylinder device providing a large output as the aforementioned cylinder device.

However, a large gripping device, such as that mentioned above, used for the purpose of performing, for example, a powerful breaking operation can seldom grip a relatively small work object without breaking the small work object. In such a powerful gripping device, the gripping force varies greatly even by a slight operation performed by an operator, thereby making it difficult for the operator to finely adjust the gripping force by operating the powerful gripping device.

The gripping device according to Patent Document 1 can grip a grip object using the pair of link connecting members that are bent along the periphery of the grip object. Therefore, the gripping device can grip the grip object without breaking the grip object. However, since the grip object is gripped by the link connecting members that can be bent along the periphery of such a gripping device, even if the arm cylinder that opens and closes the gripping links is one providing a large output, the link connecting members are deformed, thereby preventing a sufficient driving force from being transmitted to the grip object.

According to Patent Document 2, the gripping device includes an auxiliary gripping member removably mounted to an end of each gripping arm; a portion of each auxiliary gripping member that contacts a processing object is formed of an elastic material such as rubber; and each auxiliary gripping member is mounted only when gripping a relatively small processing object. However, even if such auxiliary gripping members are mounted, the driving force of the cylinder device is transmitted to the processing object as it is, thereby making it difficult to perform fine adjustments of the gripping force. In addition, there is a considerable limit as to how thick the elastic material can be made, as a result of which it is actually impossible to effectively accommodate a sudden increase in the gripping force by elastic deformation of the elastic material alone. Consequently, when the output of the hydraulic cylinder device is suddenly increased by gripping a small processing object, breakage of the processing object caused by the gripping is rarely prevented from occurring.

SUMMARY OF THE INVENTION

Accordingly, it is an object of the present invention to provide a gripping device of a working machine that can grip a processing object by a large gripping force and that can perform fine adjustments of the gripping force. It is also an object of the present invention to provide a working machine including the gripping device.

According to the present invention, there is provided a gripping device that is provided at an end of a working arm of a working machine including the working arm whose end is displaceable, and that grips a processing object. The gripping device comprises a first gripping member rotatably supported at the end of the working arm; a second gripping member rotatably supported at the end of the working arm, the second gripping member being rotatable relative to the first gripping member so that, along with the first gripping member, the second gripping member grips the processing object; and a gripping driving cylinder that extends and contracts to rotate both of the gripping members relative to each other so that the processing object is gripped by the gripping members. Here, at least one of the first gripping member and the second gripping member comprises a gripping member body that rotates relative to the other gripping member by the extension and contraction of the gripping driving cylinder; a connecting shaft secured to the gripping driving cylinder so as to follow the extension and the contraction of the gripping driving cylinder, the connecting shaft being provided at the gripping member body so as to be displaceable relative to the gripping member body only within a predetermined range in an extension direction and a contraction direction of the gripping driving cylinder, the connecting shaft rotatably connecting the gripping driving cylinder and the gripping member body to each other; and a spring member provided between the gripping member body and the connecting shaft so that driving of the gripping driving cylinder causes a driving force to be transmitted from the gripping driving cylinder to the gripping member body while the connecting shaft and the gripping member body are held in a predetermined positional relationship; so that the gripping member body is allowed to retreat by a predetermined amount with respect to the connecting shaft by elastically deforming the spring member by an opposing force received from the processing object that contacts the gripping member body as a result of rotating the gripping member body; and so that contact pressure of the gripping member body with respect to the processing object is increased by an elastic force of the spring member as the gripping member body retreats.

In the gripping device, when the gripping driving cylinder is extended and contracted, by the spring member provided between the gripping driving cylinder and the gripping member body included in at least one of the first gripping member and the second gripping member, the gripping member bodies rotate in the closing directions while the gripping member bodies and the connecting shaft are held in the predetermined positional relationship. The gripping member bodies come into contact with a processing object, and retreat with respect to the connecting shaft while the spring member is elastically deformed by an opposing force received from the processing object. In a range in which the gripping member bodies retreat, regardless of the driving force of the gripping driving cylinder, contact pressure of the gripping member bodies with respect to the processing object becomes pressure corresponding to the elastic force of the spring member. Therefore, it is possible to perform fine adjustments of the contact pressure. When the retreating of the gripping member bodies exceeds the predetermined range, the driving force of the gripping driving cylinder acts upon the processing object as it is, thereby making it possible to grip the processing object by a large gripping force.

In the present invention, when the predetermined range is exceeded, the driving force acts directly upon the gripping member bodies from the connecting shaft. Therefore, the gripping member bodies can retreat without interposing another member between the connecting shaft and the gripping member bodies that grip the processing object. Consequently, for example, compared to a structure in which, in order to allow a gripping member body to retreat, the gripping member body is divided into two portions, and the two portions are connected to each other so that the two portions are displaced relative to each other, the structure for gripping and breaking the processing object (the gripping member bodies in the present invention) can have sufficient strength. The spring member, which is interposed between the connecting shaft and the gripping member body, is provided for applying elastic force to the connecting shaft in the retreating range (the predetermined range). In the rotation range of the gripping member bodies exceeding the predetermined range, the connecting shaft and the gripping member bodies contact each other, and driving force is directly transmitted to the gripping member bodies from the connecting shaft.

More specifically, the gripping member body has a through groove capable of receiving the connecting shaft and having a shape allowing the gripping member body to retreat with respect to the connecting shaft. Here, by bringing an inner surface at the through groove and the connecting shaft into contact with each other in a closing direction of the gripping members among the extension direction and the contraction direction of the gripping driving cylinder, the gripping member body is prevented from retreating by an amount exceeding the predetermined amount.

It is desirable that the gripping device of the working machine further comprise amplifying means for causing an elastic deformation amount of the spring member to be greater than a retreating amount of the gripping member body.

According to this structure, since the elastic force of the spring member can be widely used within the restricted retreating range of the gripping member bodies, it is possible to more finely adjust the gripping force.

More specifically, the amplifying means includes a link member mounted to the gripping member body so as to be rotatable around a rotating shaft that is substantially parallel to the connecting shaft. The link member includes a holding portion and a securing portion. The holding portion holds the spring member between the link member and the gripping member body so as to allow the spring member to be stretched and compressed. The securing portion is secured to the connecting shaft so that the link member is rotatable around the rotating shaft by extending and contracting the gripping driving cylinder. Here, a rotation radius extending from the rotating shaft to the holding portion is greater than a rotation radius extending from the rotating shaft to the securing portion.

According to this structure, since the rotation radius from the rotating shaft to the holding portion is greater than the rotation radius from the rotating shaft to the securing portion, the elastic deformation amount of the spring member can be made larger than the displacement amount of the connecting shaft.

In the gripping device of the working machine, it is desirable that the holding portion of the link member hold the spring member at a position opposite to rotational center shafts of the gripping members with the gripping driving cylinder being disposed therebetween.

According to this structure, since each spring member can be disposed at a position that is separated from an end of the other gripping member and the gripping member body that grips a processing object, the probability with which the spring member contacts the processing object is low, thereby making it possible to restrict breakage of the spring member.

In the gripping device of the working machine, it is desirable that the first gripping member and the second gripping member each include the gripping member body, the connecting shaft, and the spring member.

According to this structure, compared to the structure including, for example, a gripping member body at only one of the gripping members, the stroke range that allows the gripping force to be adjusted by retreating the gripping member bodies is doubled.

According to another aspect of the present invention, there is provided a working machine comprising a movable working machine body and a working arm mounted to the working machine body and being movable so that an end thereof is displaced with respect to the working machine. Here, the gripping device is mounted to the end of the working arm.

DESCRIPTION OF THE PREFERRED EMBODIMENTS

Preferred embodiments of the present invention will hereunder be described with reference to the drawings.

Figure 1:
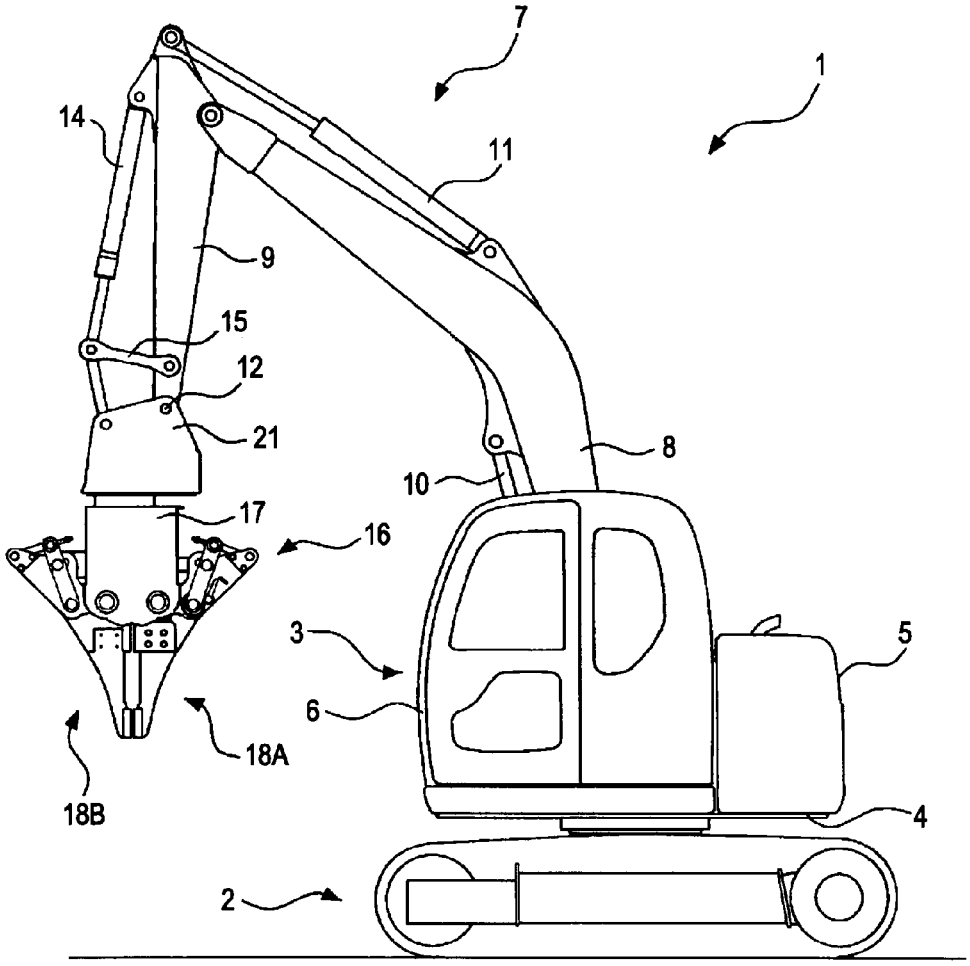
FIG. 1 shows a gripping device and a working machine including the gripping device according to an embodiment of the present invention.

FIG. 1 shows a gripping device and a working machine including the gripping device according to an embodiment of the present invention. Although, in FIG. 1, a hydraulic excavator is used as a working machine, the working machine according to the present invention is not limited thereto. The present invention is applicable to various other working machines including a working arm whose end is displaceable.

A hydraulic excavator 1 includes a lower traveling structure 2 and an upper rotating structure 3 rotatably mounted on the lower traveling structure. The upper rotating structure 3 includes a rotating frame 4, with a counterweight 5, a cabin 6, and a working arm 7 being mounted on the rotating frame 4.

The working arm 7 includes a boom 8 and an arm 9, and a boom cylinder 10 and an arm cylinder 11 for driving the boom 8 and the arm 9, respectively. The boom 8 is mounted to the rotating frame 4 so that the boom 8 can perform a derricking motion (that is, so that the boom 8 can rotate around a left-right-direction axis of the rotating frame 4), and is driven in a derricking motion direction by the extension and contraction of the boom cylinder 10. The arm 9 is rotatably connected to an end of the boom 8, and is driven in a rotation direction by the extension and contraction of the arm cylinder 11. By a combination of the rotating motions of the boom 8 and the arm 9, and the rotating motion of the rotating frame 4, an end of the arm 9 is displaceable.

The working machine according to the present invention is not limited to one that can rotate. In addition, the working arm may have one joint or a plurality of joints.

Ordinarily, a bucket (not shown) is rotatably mounted to the end of the arm 9 through a bucket pin 12, and is driven in the rotation direction by a bucket cylinder 14. More specifically, an end of an idler link 15 is rotatably mounted to the arm 9, and the other end of the idler link 15 is connected to the bucket through a bucket link. The idler link 15, the bucket link, and the bucket (not shown) are driven by extending and contracting the bucket cylinder 14. In this embodiment, a gripping device 16 is removably mounted as an working attachment in place of the bucket.

Figure 2:
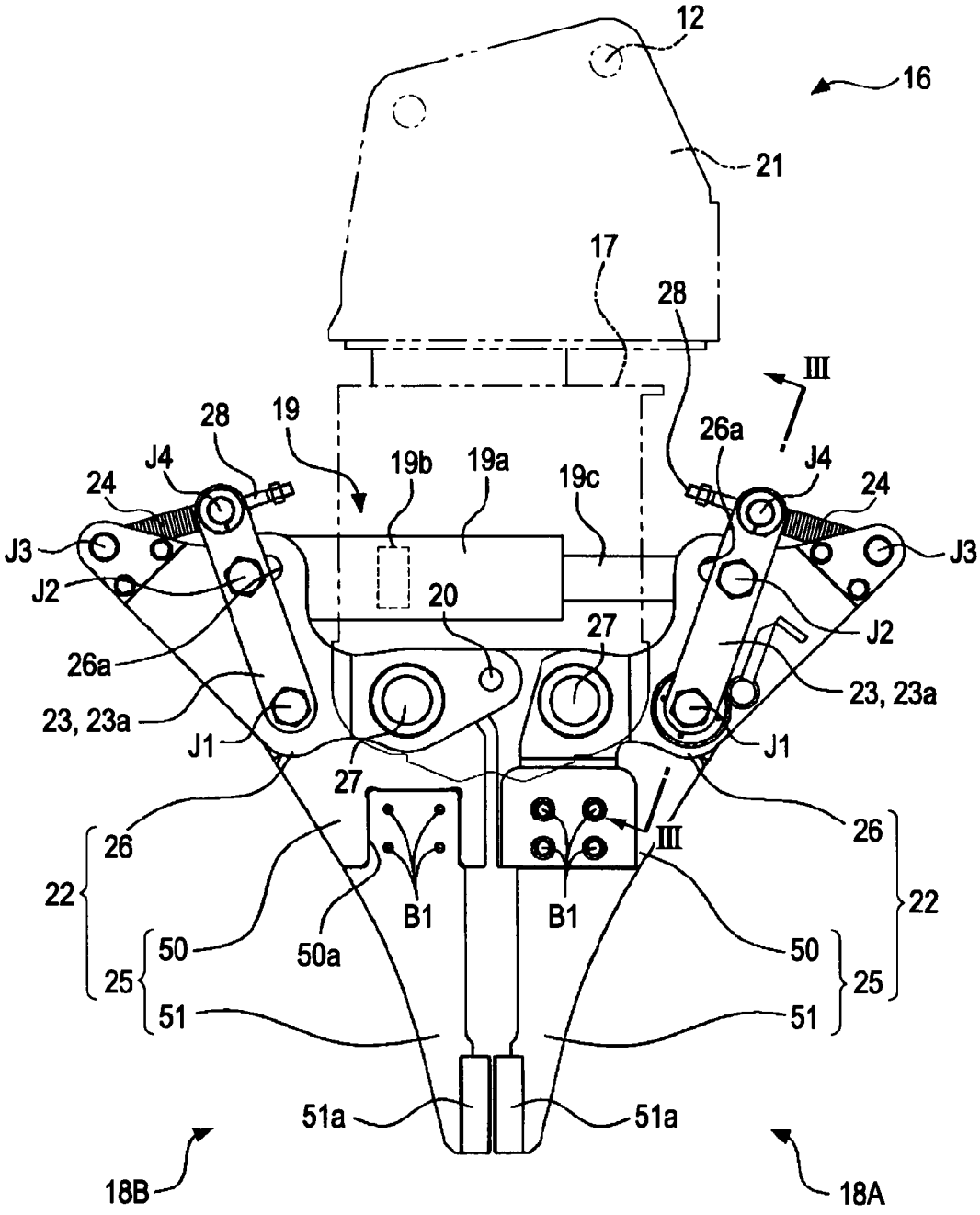
FIG. 2 is an enlarged front view of the gripping device shown in FIG. 1.
Figure 3:
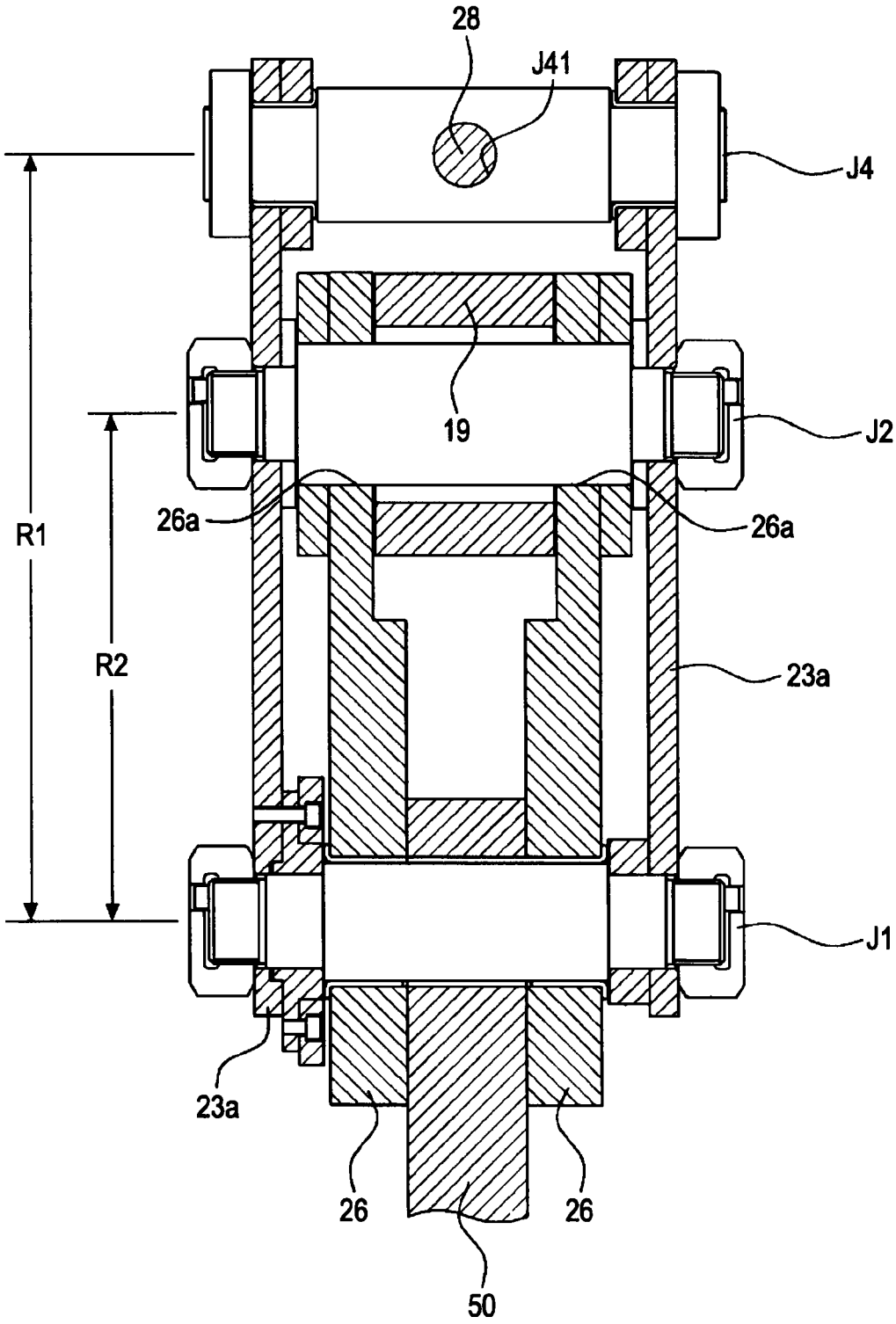
FIG. 3 is a sectional view taken along line III-III in FIG. 2.

As shown in FIG. 2, the gripping device 16 includes a gripping device body 17, a first gripping member 18A and a second gripping member 18B that form a pair of gripping members, a gripping driving cylinder 19 for driving the gripping members 18A and 18B, and a connecting pin 20 that rotatably connects the gripping members 18A and 18B to each other. A mounting portion 21 is provided at the back portion of the gripping device body 17, and is removably connected to the arm 9 and the idler link 15.

As shown in FIGS. 1 to 4, the gripping members 18A and 18B are provided for gripping respective sides of a processing object (see FIG. 4), and each includes a gripping member body 22, a link member 23, and a coil spring 24.

Figure 4:
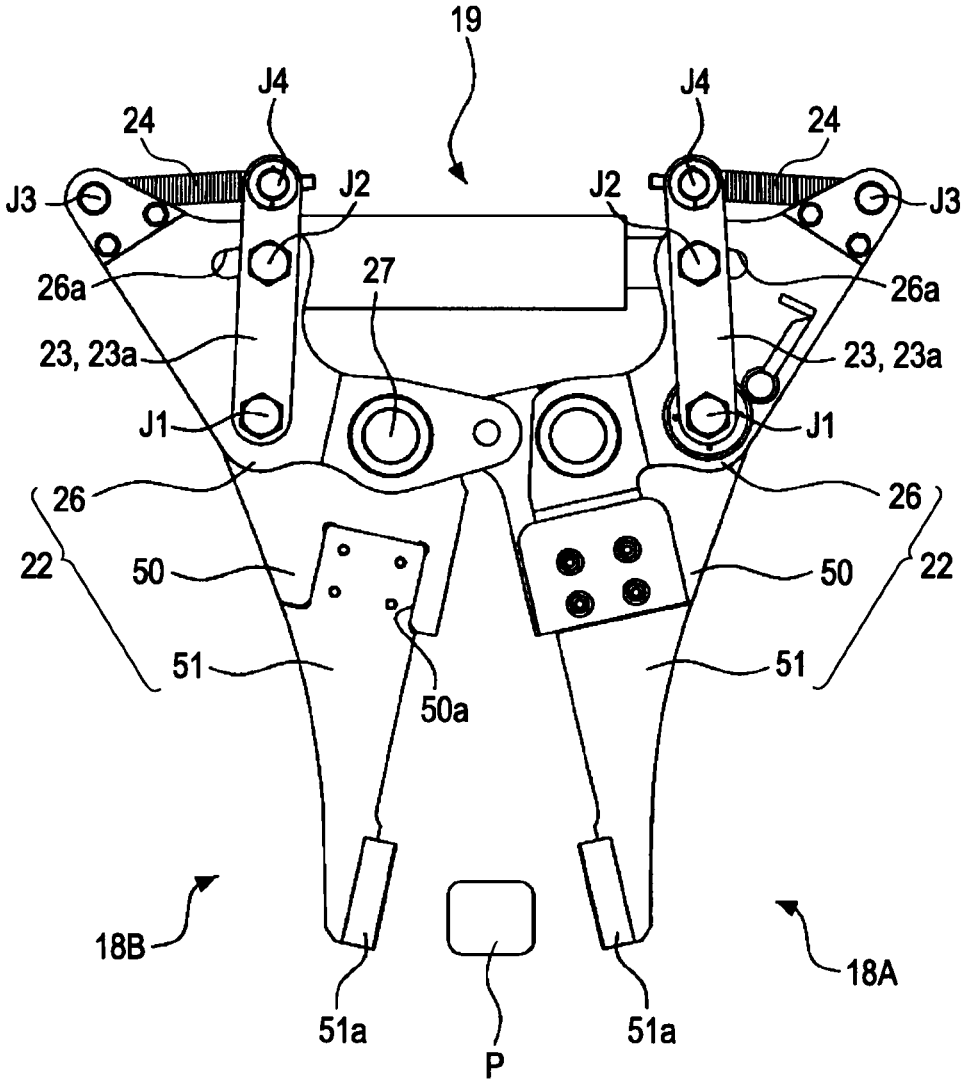
FIG. 4 is a front view that illustrates a gripping operation of the gripping members shown in FIG. 2 in a state prior to starting the gripping operation.

By rotationally driving the base end portions of the gripping member bodies 22 in opposite directions by the gripping driving cylinder 19, the gripping member bodies 22 are switched to a state in which their ends are in close contact with each other (see FIG. 2), and to a state in which the ends of the gripping member bodies 22 are separated from each other (see FIG. 4).

More specifically, the gripping member bodies 22 each include tip plates 25 for gripping the processing object P and a pair of base-end plates 26 that are disposed on respective sides of the tip plates 25. The gripping member bodies 22 are connected to the gripping device body 17 so as to be rotatable around pins 27 extending through the respective base-end plates 26.

Each of the tip plates 25 includes a clamp portion 50 that is gripped by the base-end plates 26, and a gripping portion 51 removably mounted to the end of the corresponding clamp portion 50. A groove 50*a* opening towards a front side of the corresponding clamp portion 50 (the gripping member 18A is at the back side in FIG. 2, and the gripping member 18B is at the front side in FIG. 2) is formed in the front surface of its corresponding clamp portion 50. The clamp portions 50 and the gripping portions 51, whose base end portions are inserted in the grooves 50*a*, are secured with four bolts B1 each. Accordingly, since the clamp portions 50 and the gripping portions 51 are secured while side surfaces of the gripping portions 51 and inner surfaces of the grooves 50*a* are in contact with each other, it is possible to restrict opposing forces generated at the bolts B1 and received from the processing object P when the gripping portions 51 grip the processing object P. In addition, since the gripping portions 51 are mountable to and removable from the grip portions 50, if gripping portions 51 having different lengths are provided, it is possible to suitably select gripping portions 50 having different lengths in accordance with the type of working operation. Further, if a plurality of gripping portions 51 having different flexural rigidities are provided, it is possible to grip the processing object P with different gripping forces in accordance with the types of gripping portions 51. The gripping portions 51 have respective protrusions 51*a* that protrude inwardly from the respective ends thereof and that allow the processing object P to be gripped between the gripping portions 51.

Three shafts J1, J2, and J3 extending through each of the base-end plates 26 and extending parallel to the axes of the pins 27 are provided at each of the base-end plates 26. Each shaft J1 extends through the base-end plates 26 at the outer side of the corresponding pin 27. Each shaft J2 is provided closer to the working arm 7 than the corresponding shaft J1, and is inserted into a corresponding through groove 26*a* so as to be slidable in the corresponding through groove 26*a* (see FIGS. 6A and 6B) extending through the base-end plates 26 and having an arch shape with the corresponding shaft J1 serving as center. More specifically, each shaft J2 is slidable in its corresponding through groove 26*a* between a position shown in FIG. 6A where the shaft J2 contacts an inner end portion of the corresponding through groove 26*a* and a position shown in FIG. 6B where the shaft J2 contacts an outer end portion of the corresponding through groove 26*a*.

The shafts J2 support one end (which is extended and contracted) of the gripping driving cylinder 19 (that is, a rod-side end portion or a head-side end portion) that is disposed between the base-end plates 26, so as to be rotatable with respect to the base-end plates 26. The shafts J3 rotatably support respective spring supporting shafts 28 for supporting the coil springs 24. More specifically, the shafts J3 rotatably support the base-end portions of the spring supporting shafts 28 disposed between the base-end plates 26.

The gripping driving cylinder 19 is a hydraulic cylinder, and is held between the base-end portions of the gripping member bodies 22. The gripping driving cylinder 19 includes a cylinder body 19*a*, a piston 19*b*, and a rod 19*c*. The piston 19*b* is accommodated in the cylinder body 19*a*. The rod 19*c* extends towards one side along a cylinder axis direction from the piston 19*b*. An end of the rod 19*c* is rotatably connected to the base-end portion of the gripping member body 22 of the first gripping member 18A, and a head-side end portion of the cylinder body 19*a* is connected to the base end portion of the gripping member body 22 of the second gripping member 18B. Therefore, by extending and contracting the gripping driving cylinder 19, both of the gripping member bodies 22 are driven in an opening-closing direction.

More specifically, while the end of the rod 19*c* is interposed between both of the base-end plates 26 of the first gripping member 18A, the end of the rod 19*c* is rotatably supported at both of the base-end plates 26 by the shaft J2. While the head-side end portion of the cylinder body 19*a* is interposed between both of the base-end plates 26 of the second gripping member 18B, the head-side end portion of the cylinder body 19*a* is rotatably supported at the base-end plates 26 by the shaft J2. That is, both end portions (the shafts J2) of the gripping driving cylinder 19 are supported at the base-end plates 26 so that they can be displaced relative to each other by a predetermined displacement amount along the through holes 26*a* with respect to both of the base-end plates 26.

Each link member 23 includes a pair of lever plates 23*a*, each pair being provided at the outer side of the base-end plates 26. A base-end portion of each lever plate 23*a* is rotatably supported at the corresponding base-end plates 26 by the corresponding shaft J1. Intermediate portions of the lever plates 23*a* are rotatably supported at the end portions of the gripping driving cylinder 19 by the respective shafts J2. Shafts J4 extending parallel to an axis of the corresponding pin 27 and extending on respective sides of the lever plates 23*a* are provided at ends of the lever plates 23*a*. A hole J41 (see FIG. 3) extending through the corresponding shaft J4 perpendicularly to the axis of the corresponding shaft J4 is formed in the corresponding shaft J4. The spring supporting shafts 28 are inserted in the respective holes J41. Therefore, when the link members 23 are rotated around the respective shafts J1 in directions in which ends of the link members 23 move away from each other, the coil springs 24 (mounted to the outer sides of the respective spring supporting shafts 28) are compressed between the shafts J3 and side surfaces of the shafts J4. By elastic forces resulting from the compression, the link members 23 are rotated in directions in which their ends move closer to each other. That is, the coil springs 24 are provided so that the shafts J2 (the intermediate portions of the link members 23) are biased inwardly with respect to the gripping member bodies 22.

Here, a rotation radius R1 extending from the shaft J1 (a rotating shaft of the link member 23) to the shaft J4 (a portion that holds the coil spring 24) is greater than a rotation radius R2 extending from the shaft J1 to the shaft J2. Therefore, the amount of displacement of the shaft J2 resulting from driving the gripping driving cylinder 19 can be made larger than the amount of elastic deformation of the coil spring 24.

The coil springs 24 are situated closer to the working arm 7 (base end portion) than the pins 27 with the gripping driving cylinder 19 being disposed therebetween. More specifically, in the embodiment, each lever plate 23*a* has a longitudinal size extending beyond a base end portion (where the corresponding shaft J3 is disposed) of each base-end plate 26 and to the working arm 7. As a result of supporting the spring supporting shafts 28 at the ends of the lever plates 23*a*, the coil springs 24 are disposed closer to the working arm 7 than the shafts J2.

Next, the operation of the gripping device 16 will be described.

By driving the gripping members 18A and 18B in the opening-closing directions by extending and contracting the gripping driving cylinder 19, the gripping device 16 grips a processing object P. First, as shown in FIG. 4, while the gripping members 18A and 18B are open, the working arm 7 is operated so that the gripping member bodies 22 (the protrusions 51*a*) of the respective gripping members 18A and 18B are positioned on both outer sides of the processing object P. By operating the gripping driving cylinder 19 in extension and contraction directions with the gripping members 18A and 18B being positioned on the outer sides of the processing object P, the gripping members 18A and 18B are rotated towards each other by the biasing forces of the coil springs 24 while the coil springs 24 are kept compressed by a certain amount.

Figure 5B:
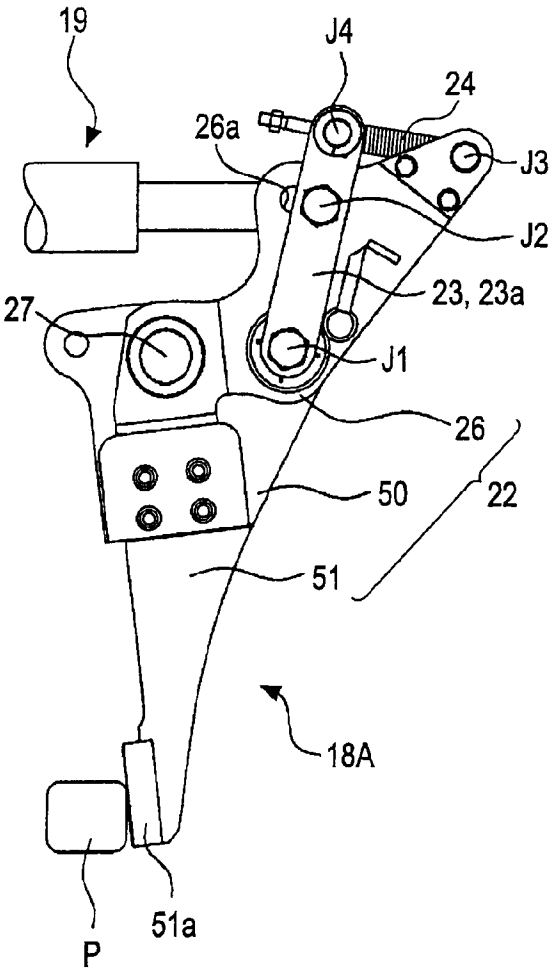
FIGS. 5A and 5B are front views that illustrate the gripping operation of the gripping members shown in FIG. 2, with FIG. 5A showing a state in which gripping member bodies and a processing object contact each other, and FIG. 5B showing a state in which the gripping member bodies are retreated.
Figure 5A:
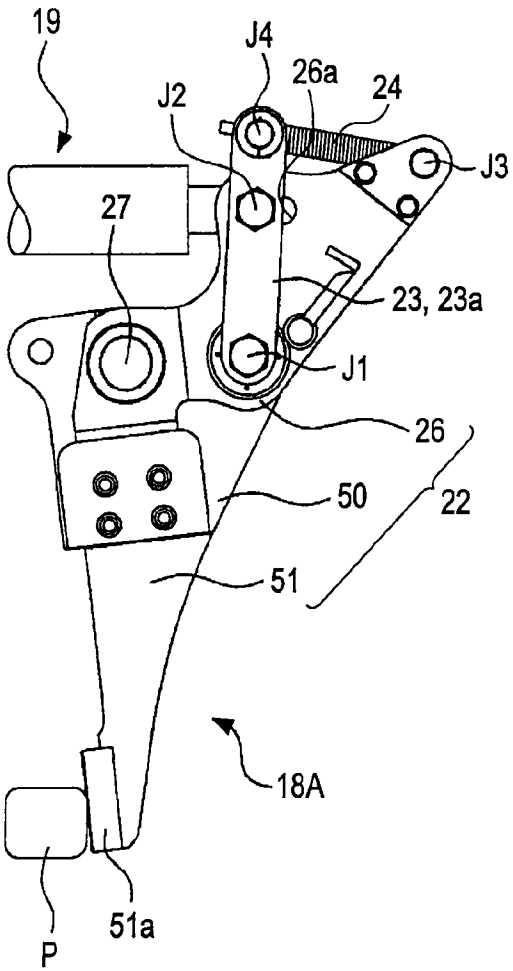

The gripping operation causes the protrusions 51*a* to contact the processing object P (see FIG. 5A). As shown in FIG. 6A, the shafts J2 are held at the gripping member bodies 22 at positions in which the shafts J2 are displaced inwardly from the gripping member bodies 22 by the elastic forces of the coil springs 24. Therefore, the shafts J2 are displaced relative to the gripping member bodies 22 by extending and contracting the gripping driving cylinder 19 after the protrusions 51*a* start contacting the processing object P. That is, the gripping member bodies 22 retreat with respect to the shafts J2, so that fine adjustments of the gripping forces and gripping of the processing object P with large gripping forces can both be performed.

More specifically, for a while after the protrusions 51*a* of the respective gripping member bodies 22 have contacted the processing object P, the following occurs. That is, when both of the gripping member bodies 22 rotate in the closing directions, opposing forces that the protrusions 51*a* receive from the processing object P cause the gripping member bodies 22 to retreat with respect to the shafts J2 while the coil springs 24 are elastically deformed (see FIGS. 5B and 6B). In a range in which the retreating is allowed (that is, in a range from the state shown in FIG. 6A to the state shown in FIG. 6B), regardless of the driving force of the gripping driving cylinder 19, the contact pressures of the gripping member bodies 22 and the processing object P become pressures based on the elastic forces of the coil springs 24. More specifically, in the gripping device 16, the elastic forces of the coil springs 24 act upon the processing object P with a proportion corresponding to the distances between the pins 27 (fulcra) and the respective shafts J3 (points upon which a force acts) upon which the elastic forces of the coil springs 24 act and the distances between the pins 27 and contact position of the processing object P (point of application of a force).

Therefore, in this range, fine adjustments of the contact pressures can be performed by making use of changes in the elastic forces of the coil springs 24 resulting from the retreating of the gripping member bodies 22 caused by the gripping driving cylinder 19. For example, a small processing object P can be gripped without breaking it.

Figure 6B:
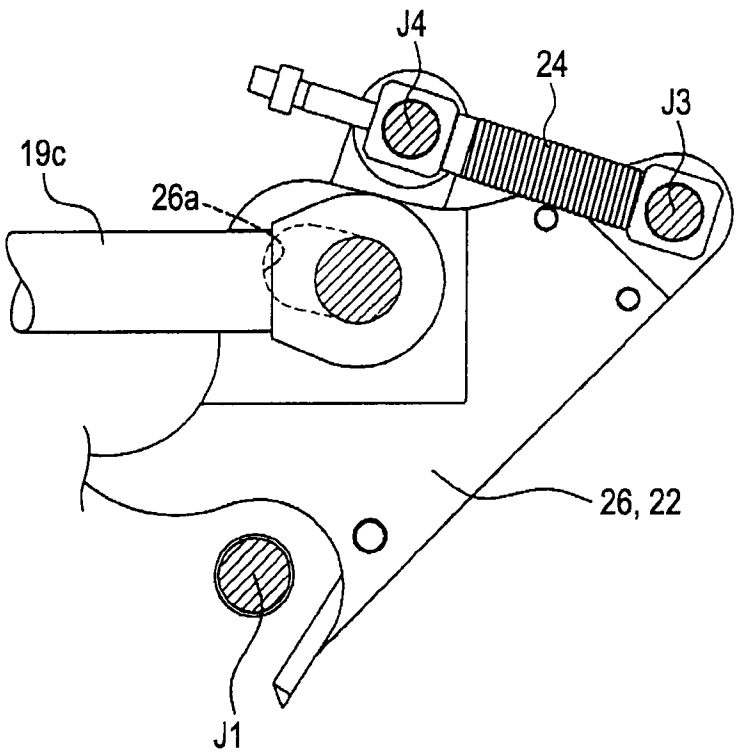
FIGS. 6A and 6B are sectional views that illustrate the gripping operation of the gripping members shown in FIG. 2, with FIG. 6A showing the state corresponding to FIG. 5A, and FIG. 6B showing the state corresponding to FIG. 5B.
Figure 6A:
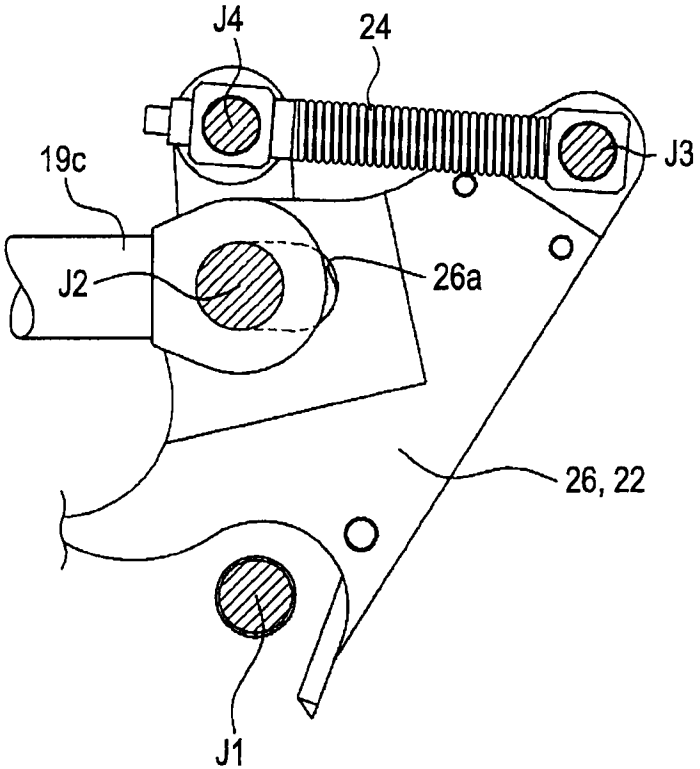

In contrast, when the gripping member bodies 22 retreat by the predetermined amount, as shown in FIG. 6B, the shafts J2 contact the outer-side end portions of the through grooves 26*a*, thereby preventing the gripping member bodies 22 from retreating further (that is, the gripping member bodies 22 and the shafts J2 are integrated to each other). Therefore, the driving force applied to each gripping member body 22 from the gripping driving cylinder 19 is applied as it is to the processing object P as gripping force. Consequently, the processing object P can be gripped by large gripping forces in this state. For example, the processing object P can be gripped for the purpose of breaking it.

In particular, after the shafts J2 have contacted the outer-side end portions of the through grooves 26*a*, the driving forces act directly upon the gripping member bodies 22 from the shafts J2 in the gripping device 16. Therefore, the gripping member bodies 22 can retreat without interposing another member between the shafts J2 and the gripping member bodies 22 that grip the processing object P. Consequently, for example, compared to the structure in which, in order to allow the gripping member bodies 22 to retreat, the gripping member body 22 is divided into two portions, and the two portions are connected to each other so that the two portions are displaced relative to each other, the structure for gripping and breaking the processing object P (the gripping member bodies 22 in the embodiment) can have sufficient strength.

Figure 7:
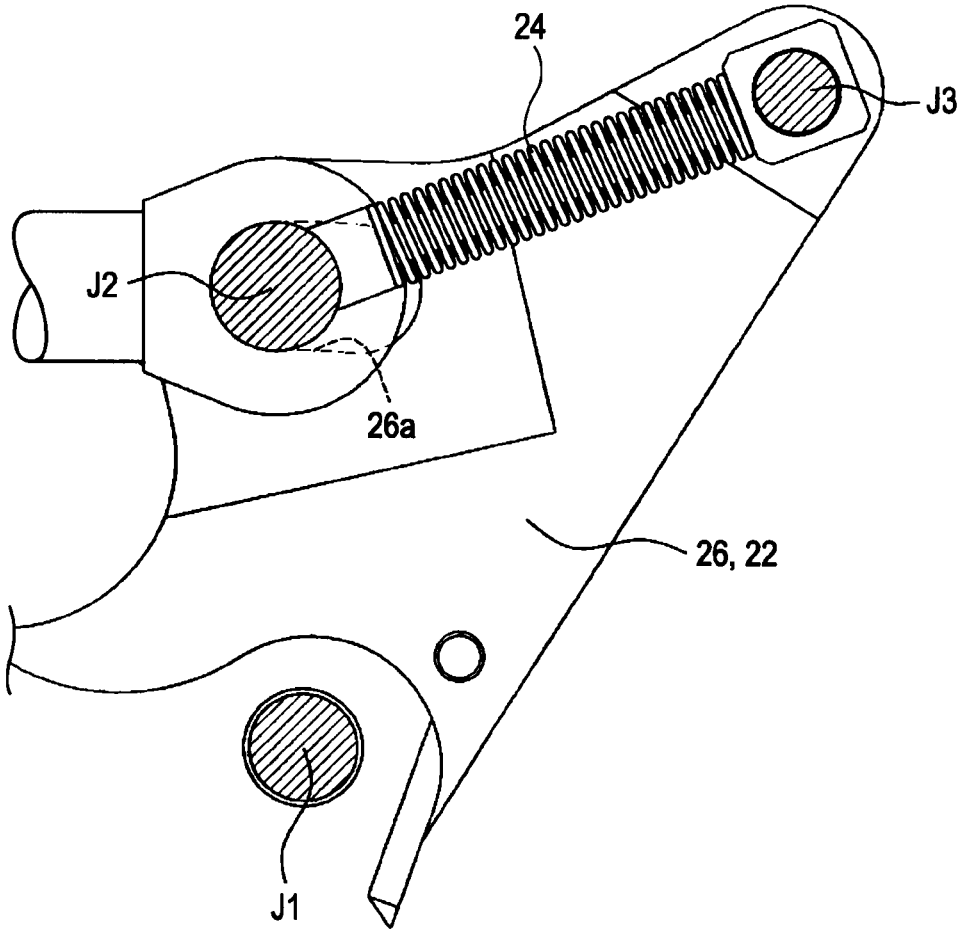
FIG. 7 is a sectional view of a gripping device according to another embodiment of the present invention.

Although, in the embodiment, the link members 23 are interposed between the respective shafts J2 and the respective gripping member bodies 22, as shown in FIG. 7, the coil springs 24 can be directly provided between the shafts J2 and the gripping member bodies 22 (the shafts J4). However, when, as in the embodiment, the structure in which the link members 23 are interposed between the shafts J2 and the gripping member bodies 22, and the coil springs 24 are held closer to the ends of the link members 23 than the shafts J2 is used, the stretching amount and compression amount of the coil springs 24 can be greater than the displacement amounts of the shafts J2 resulting from the gripping driving cylinder 19. Therefore, fine adjustments of the gripping forces can be performed.

Figure 8:
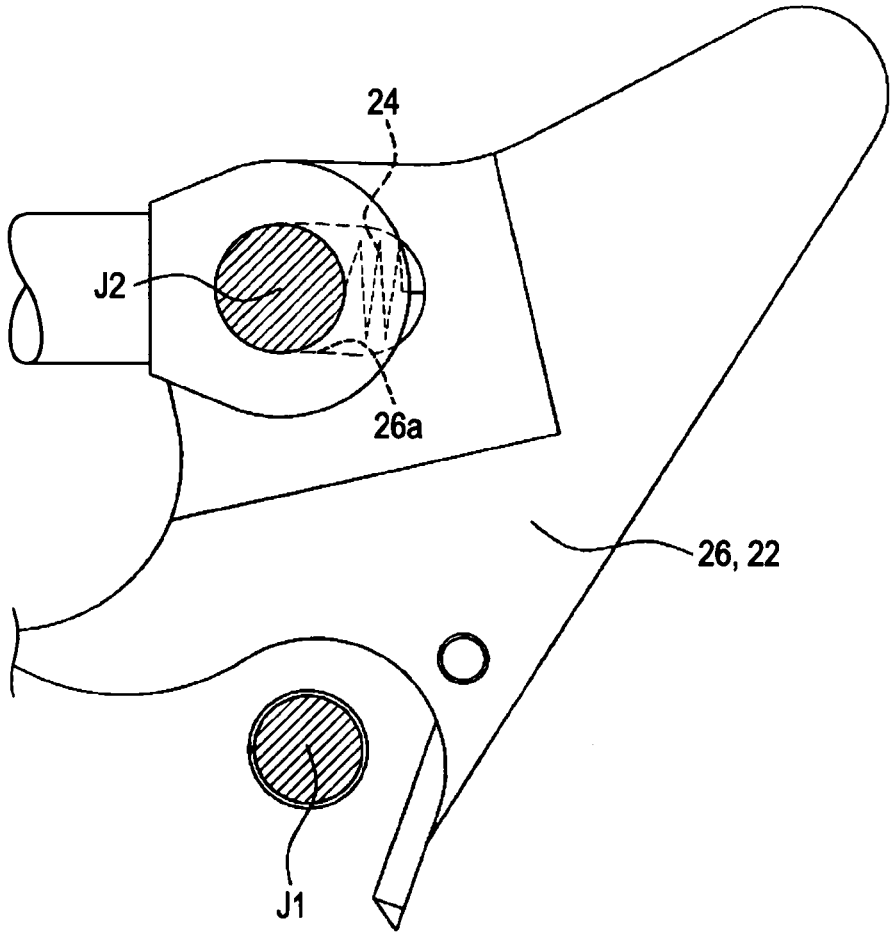
FIG. 8 is a front view of a gripping device according to still another embodiment of the present invention.

When the coil springs 24 are directly disposed between the respective shafts J2 and the respective gripping member bodies 22, the shafts J3 can be omitted. That is, as shown in FIG. 8, when the coil springs 24 that are in a compressed state are disposed between the inner surfaces of the through holes 26*a* and the outer peripheral surfaces of the shafts J2, the shafts J3 can be omitted.

Figure 9:
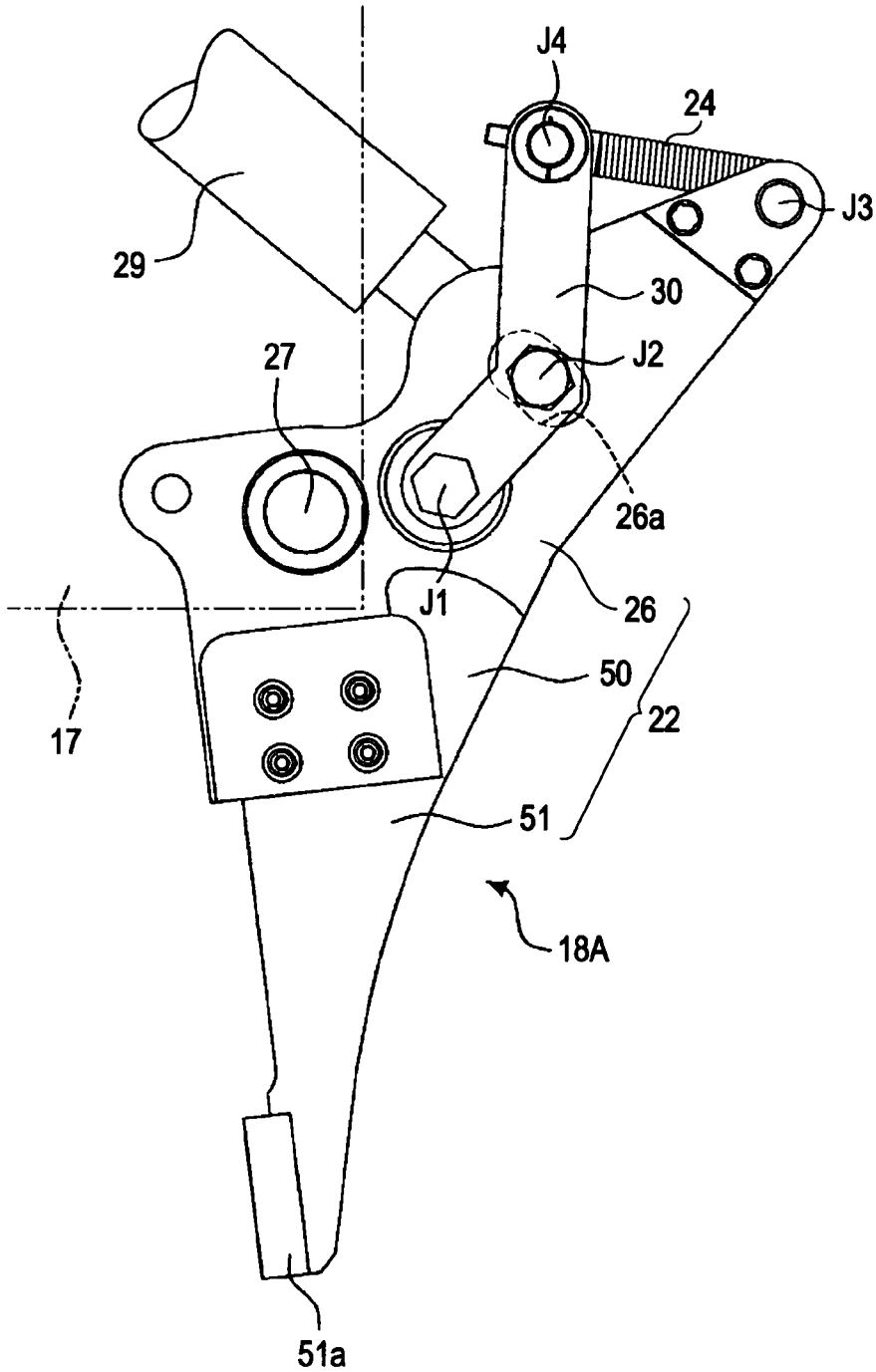
FIG. 9 is a front view of a gripping device according to still another embodiment of the present invention.

Further, although, in the embodiment, the structure in which both of the gripping members 18A and 18B are rotated by one gripping driving cylinder 19 is described, as shown in FIG. 9, one gripping driving cylinder 19 may be provided for each of the gripping members 18A and 18B for driving each of the gripping members 18A and 18B.

More specifically, in an embodiment shown in FIG. 9, a gripping device includes a pair of gripping driving cylinders 29 (only one gripping driving cylinder 29 is shown in FIG. 9) and link members 30. The gripping driving cylinders 29 have their head-side end portions secured to the gripping device body 17. The link members 30 are supported at the gripping member bodies 22 so as to be rotatable around the respective shafts J1. The link members 30 each have an L shape, which differs from the shape in the previous embodiment. The shafts J2 extend through the link members 30 at bent portions of the link members 30, and support rod-side end portions of the gripping driving cylinders 29 with respect to the link members 30 and the gripping member bodies 22.

Even in the embodiment, when the gripping driving cylinder 29 is extended or contracted, the gripping member bodies 22 can retreat with respect to the shafts J2 along the through grooves 26*a*. For this reason, fine adjustment of gripping forces can be performed by the elastic forces of the coil springs 24 corresponding to the retreating displacement amounts of the gripping member bodies 22.

Although, in the embodiments, the coil springs 24 are used as spring members, for example, leaf springs that can be elastically deformed may be used between the shafts J2 and the gripping member bodies 22.

As mentioned above, in the gripping device 16, when the gripping driving cylinder 19 is extended and contracted, by the coil springs 24 (provided between the gripping driving cylinder 19 and the gripping member body 22 of the gripping member 18A and between the gripping driving cylinder 19 and the gripping member body 22 of the gripping member 18B), the gripping member bodies 22 rotate in the closing direction while the gripping member bodies 22 and the shafts J2 are held with the predetermined positional relationship (the state shown in FIG. 6A). This causes the gripping member bodies 22 to come into contact with the processing object P. Then, opposing forces received from the processing object P cause the gripping member bodies 22 to retreat with respect to the shafts J2 while the coil springs 24 are elastically deformed. In the range in which the gripping member bodies 22 retreat, regardless of the driving force of the gripping driving cylinder 19, the contact pressures of the gripping member bodies 22 with respect to the processing object P become pressures corresponding to the elastic forces of the spring members 24. Therefore, it is possible to perform fine adjustments of the contact pressures. When the retreating of the gripping member bodies 22 exceeds the predetermined range, the driving force of the gripping driving cylinder 19 acts upon the processing object P as it is, thereby making it possible to grip the processing object P by large gripping forces.

In the embodiments, when the predetermined range is exceeded, the driving force acts directly upon the gripping member bodies 22 from the shafts J2. Therefore, the gripping member bodies 22 can retreat without interposing another member between the shafts J2 and the gripping member bodies 22 that hold the processing object P. Therefore, for example, compared to the structure in which, in order to allow the gripping member body 22 to retreat, the gripping member body 22 is divided into two portions, and the two portions are connected to each other so that the two portions are displaced relative to each other, the structure (the gripping member bodies 22 in the present invention) for gripping and breaking the processing object P can have sufficient strength.

If, as in the embodiments, the structure includes the link members 23 and is such that the rotation radius R1 extending from the shaft J1 to the shaft J4 (holding portion) is greater than the rotation radius R2 extending from the shaft J1 to the shaft J2, the elastic deformation amount of each coil spring 24 can be greater than the displacement amount of the shaft J2.

If, as in the embodiments, the coil springs 24 are held at the positions opposite to the respective pins 27 with the gripping driving cylinder 19 being disposed therebetween, each coil spring 24 can be disposed at a position that is separated from the corresponding gripping member body 22 that grips the processing object P and the end of other gripping member. Therefore, it is possible to restrict breakage of the coil springs 24 by reducing the probability with which the coil springs 24 contact the processing object P.

Although the invention has been described with reference to the preferred embodiments in the attached figures, it is noted that equivalents may be employed and substitutions made herein without departing from the scope of the invention as recited in the claims.

What is claimed is:

1. A gripping device that is provided at an end of a working arm of a working machine including the working arm whose end is displaceable, and that grips a processing object, the gripping device comprising:

a first gripping member rotatably supported at the end of the working arm;

a second gripping member rotatably supported at the end of the working arm, the second gripping member being rotatable relative to the first gripping member so that, along with the first gripping member, the second gripping member grips the processing object; and a gripping driving cylinder that extends and contracts to rotate both of the gripping members relative to each other so that the processing object is gripped by the gripping members, wherein at least one of the first gripping member and the second gripping member comprises:

a gripping member body that rotates relative to the other gripping member by the extension and contraction of the gripping driving cylinder;

a connecting shaft secured to the gripping driving cylinder so as to follow the extension and the contraction of the gripping driving cylinder, the connecting shaft being provided at the gripping member body so as to be displaceable relative to the gripping member body only within a predetermined range in an extension direction and a contraction direction of the gripping driving cylinder, the connecting shaft extending parallel to rotation axes of the gripping members, the connecting shaft rotatably connecting the gripping driving cylinder and the gripping member body to each other; and a spring member provided between the gripping member body and the connecting shaft so that driving of the gripping driving cylinder causes a driving force to be transmitted from the gripping driving cylinder to the gripping member body while the connecting shaft and the gripping member body are held in a predetermined positional relationship; so that the gripping member body is allowed to retreat by a predetermined amount with respect to the connecting shaft by elastically deforming the spring member by an opposing force received from the processing object that contacts the gripping member body as a result of rotating the gripping member body; and so that contact pressure of the gripping member body with respect to the processing object is increased by an elastic force of the spring member as the gripping member body retreats, wherein the gripping member body has a through groove capable of receiving the connecting shaft and having a shape allowing the gripping member body to retreat with respect to the connecting shaft, and wherein, by bringing an inner surface at the through groove and the connecting shaft into contact with each other in a closing direction of the gripping members among the extension direction and the contraction direction of the gripping driving cylinder, the gripping member body is prevented from retreating by an amount exceeding the predetermined amount.

2. The gripping device of the working machine according to claim 1, further comprising:

amplifying means for causing an elastic deformation amount of the spring member to be greater than a retreating amount of the gripping member body.

3. The gripping device of the working machine according to claim 2, wherein the amplifying means includes a link member mounted to the gripping member body so as to be rotatable around a rotating shaft that is substantially parallel to the connecting shaft, wherein the link member includes a holding portion and a securing portion, the holding portion holding the spring member between the link member and the gripping member body so as to allow the spring member to be stretched and compressed, the securing portion being secured to the connecting shaft so that the link member is rotatable around the rotating shaft by extending and contracting the gripping driving cylinder, and wherein a rotation radius extending from the rotating shaft to the holding portion is greater than a rotation radius extending from the rotating shaft to the securing portion.

4. The gripping device of the working machine according to claim 3, wherein the holding portion of the link member holds the spring member at a position opposite to rotational center shafts of the gripping members with the gripping driving cylinder being disposed therebetween.

5. The gripping device of the working machine according to claim 1, wherein the first gripping member and the second gripping member each include the gripping member body, the connecting shaft, and the spring member.

6. A working machine comprising:

a movable working machine body;

a working arm mounted to the working machine body, the working arm being movable so that an end thereof is displaced with respect to the working machine; and the gripping device according to claim 1 mounted to the end of the working arm.

* * * * *